US006694681B1

(12) United States Patent
Andres

(10) Patent No.: US 6,694,681 B1
(45) **Date of Patent: *Feb. 24, 2004**

(54) FLOOR ASSEMBLY HAVING AN EXTRUSION AND SNAP CONNECTOR

(75) Inventor: Thomas J. Andres, North Versailles, PA (US)

(73) Assignee: Thermal Industries, Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/543,989

(22) Filed: Apr. 6, 2000

Related U.S. Application Data

(62) Division of application No. 09/088,250, filed on Jun. 1, 1998, now Pat. No. 6,112,479.

(51) Int. Cl.[7] ..... E04F 15/10
(52) U.S. Cl. ..... 52/177; 52/489.1; 405/218
(58) Field of Search ..... 52/177, 180, 181, 52/480, 773, 138.1, 483.1, 489.1; 405/218, 219; 14/73; 114/264, 266

(56) References Cited

U.S. PATENT DOCUMENTS

| | | | |
|---|---|---|---|
| 3,620,027 | A | 11/1971 | Nordell |
| 3,815,550 | A | 6/1974 | Becker |
| 3,914,913 | A | 10/1975 | Roberts |
| 3,959,830 | A | 6/1976 | van den Broek |
| 4,058,942 | A | 11/1977 | Naka |
| 4,078,515 | A | 3/1978 | Svirklys |
| 4,135,339 | A | 1/1979 | Pawlitschek |
| 4,266,381 | A | 5/1981 | Deller |
| 4,436,274 | A | 3/1984 | Kramer |
| 4,840,824 | A | 6/1989 | Davis |
| 4,905,431 | A | 3/1990 | Davis |
| 4,907,387 | A | 3/1990 | Turnbull |
| 4,947,595 | A | 8/1990 | Douds et al. |
| 4,964,618 | A | 10/1990 | Kennedy et al. |
| 5,009,045 | A | 4/1991 | Yoder |
| 5,048,448 | A | 9/1991 | Yoder |
| 5,070,664 | A | 12/1991 | Groh et al. |
| 5,103,614 | A | 4/1992 | Kawaguchi et al. |
| 5,553,427 | A | 9/1996 | Andres |
| 5,613,339 | A | 3/1997 | Pollock |

*Primary Examiner*—Michael Safavi
(74) *Attorney, Agent, or Firm*—David V. Radack; William F. Lang, IV; Eckert Seamans Cherin & Mellott, LLC

(57) ABSTRACT

A floor assembly having a plurality of elongated extrusions and a cooperating snap connector that is secured to a rigid underlying support. Each extrusion includes a pair of outer leg members and a pair of inner leg members, each of the outer leg members being connected to an adjacent inner leg member by horizontal support member. Each inner leg member includes a retaining tab extending therefrom. The snap connector includes an elongated base portion and a pair of flanges attached to opposed major sides of the base portion. The retaining tabs cooperate with the bottom section of the flanges to mechanically secure the extrusions to the snap connector. The snap connector is secured to the rigid underlying support.

7 Claims, 4 Drawing Sheets

FLOOR ASSEMBLY HAVING AN EXTRUSION AND SNAP CONNECTOR

This application is a divisional of prior U.S. application Ser. No. 09/088,250 filed Jun. 1, 1998, now U.S. Pat. No. 6,112,479.

BACKGROUND OF THE ONION

This invention relates to floor assemblies, and more particularly, to plastic extrusions which are connected to a rigid underlying support, such as wood joists, by a snap connector.

It is very well known to construct floor assemblies, such as decks for homes and boat docks, using wood planks secured to an underlying support, such as spaced wood joists. There are, however, several disadvantages with using exposed wood planks for these applications. Wood, if left untreated, can very quickly rot, thus requiring replacement of some if not all of the wood planks. This occurs especially for wood decks and boat docks that are subject to outdoor weather conditions such as rain, snow and sunlight. In addition, wood planks can shrink, creating unsightly and dangerous gaps in the planking. Finally, wood is becoming more and more expensive.

Pressure treated lumber is widely used to protect the wood from rotting, however, even pressure treated lumber begins to rot over time with exposure to the elements. In addition, it is recommended by most vendors of pressure treated lumber that a protectant be applied to the wood. This protectant usually must be applied yearly. This is a major disadvantage of wood decks, due to the expense and time consuming nature of applying and reapplying this protectant year after year. Failure to be diligent in these applications can lead to early rotting of the exposed wood planks and the major expense and inconvenience of replacing some if not all of the wood planks.

It is known to provide a floor assembly constructed of an extrusion secured to a snap connector, which in turn, is secured to a rigid underlying support, such as wood joists. For example, my commonly owned U.S. Pat. No. 5,553,427 discloses such a floor assembly. While this floor assembly is effective and well-suited for its intended purposes, improvements and advancements which would result in even better floor assemblies are desirable.

What is needed, therefore, is a floor assembly having an extrusion and associated snap connector which provides for improvements over the prior art.

SUMMARY OF THE INVENTION

The invention has met the above mentioned needs as well as others. Specifically, the invention includes a floor assembly which is secured to a rigid underlying support, such as wood joists. The floor assembly includes a plurality of elongated extrusions with each of the elongated extrusions including a pair of outer leg members and a pair of inner leg members. In accordance with an important aspect of the invention, each outer leg member is connected to an adjacent inner leg member by a horizontal support member. The horizontal support member improves the overall structural integrity of the elongated extrusions. Each inner leg member also includes a retaining tab extending therefrom.

The floor assembly also includes a snap connector having an elongated based portion and a pair of flanges attached to opposed major sides of the base portion. Each of the flanges extend generally outwardly from the base portion and define, along with the rigid underlying support, a recessed space.

Preferably, the elongated extrusions and/or the snap connector is made of a resilient material, such as polyvinyl chloride (PVC), so that the elongated extrusions may be pressed onto the snap connector and then snapped in place to mechanically secure the elongated extrusions to the snap connector. Preferably, the retaining tabs of the inner legs are received in the recessed space in order to provide for the mechanical securing of the elongated extrusions to the snap connectors.

BRIEF DESCRIPTION OF THE DRAWINGS

A full understanding of the invention can be gained from the following description of the preferred embodiment when read in conjunction with the accompanying drawings in which.

DETAILED DESCRIPTION

The extrusions and snap connector shown herein are used to form floor assemblies, such as an outdoor residential deck. It will be appreciated however, that there are numerous other uses for the extrusions and/or snap connector disclosed herein including but not limited to boat docks and boat decks, enclosure patios, dance floors or any flooring assembly where other materials, such as wood, are currently used. Therefore, although the description set forth herein focusses on a residential deck, it will be appreciated that the invention is not so limited and can encompass other flooring assemblies such as those mentioned above and more.

Figure 1:
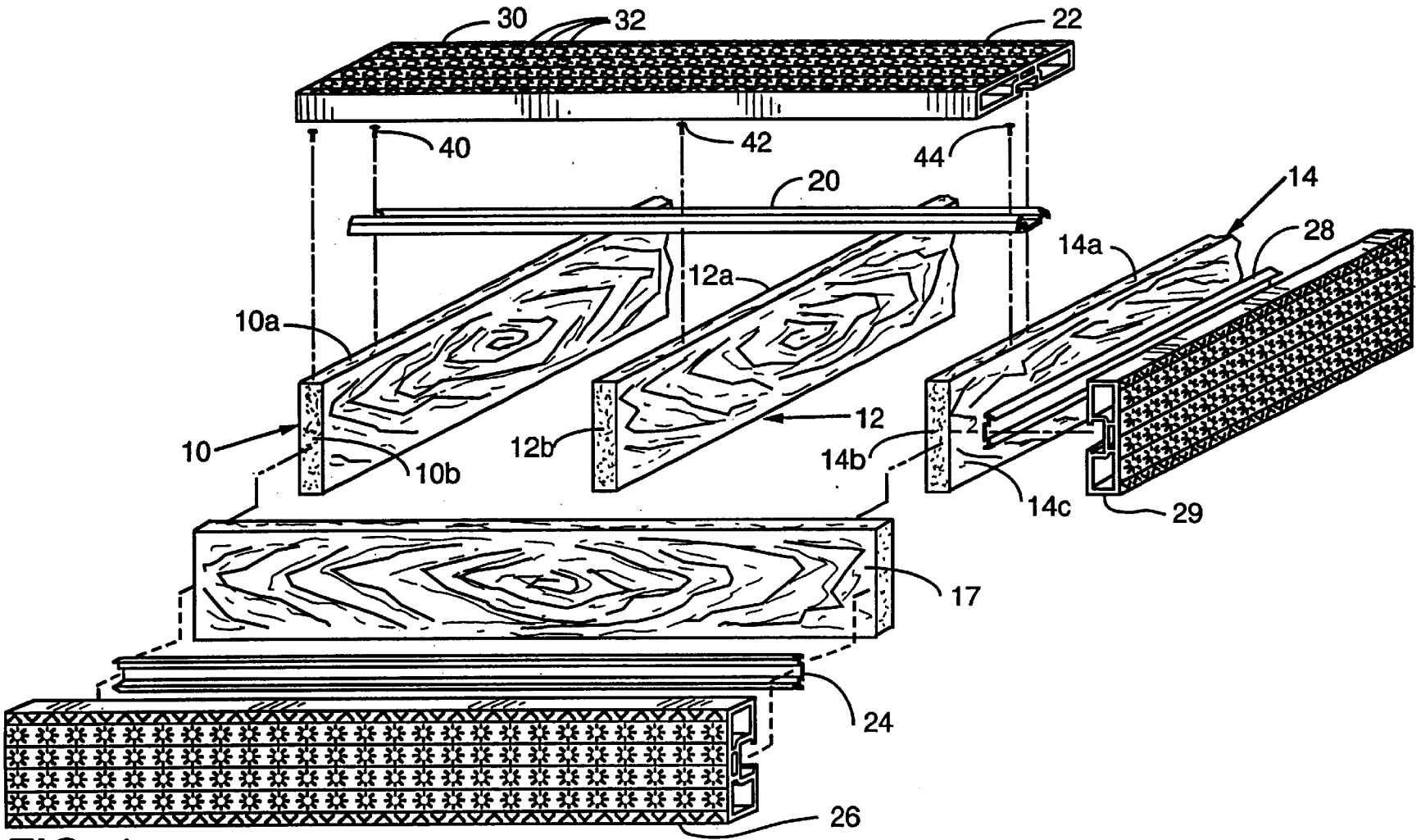
FIG. 1 is an exploded perspective view of the floor assembly of the invention.

Referring now to FIG. 1, an exploded perspective view of a floor assembly of the invention is shown. The floor assembly consists of a plurality of spaced parallel wood joists 10, 12, 14 which form the foundation of decking. The spaced parallel wood joists 10, 12, 14 each have a horizontal surface 10*a*, 12*a*, 14*a*, respectively. These wood joists 10, 12, 14 form a part of the underlying rigid support for the extrusions (discussed below). A wood joist 17 is also mounted to narrow vertical sides 10*b*, 12*b*, 14*b* of each of the wood joists 10, 12, 14, respectively, in order to complete the underlying rigid support for the floor assembly.

The floor assembly further consists of a snap connector 20 to which is connected an elongated flooring extrusion 22. It will be appreciated that a plurality of extrusions 22 and snap connectors 20 are mounted generally perpendicularly to the horizontal surface 10*a*, 12*a*, 14*a* of the wood joists 10, 12, 14 in order to form the flooring assembly. FIG. 1 also shows a snap connector 24 and an extrusion 26 that can be mounted to joist 17, which was initially secured on the narrow vertical sides 10*b*, 12*b*, 14*b* of wood joists 10, 12, 14. Yet another snap connector 28 and an extrusion 29 can be mounted to wide vertical side 14*c* of wood joist 14 in order to complete the floor assembly.

As can be seen in FIG. 1, the extrusion 22 has an exposed surface 30 including a plurality of depressions 32 which make the floor slip-resistant.

Figure 2:
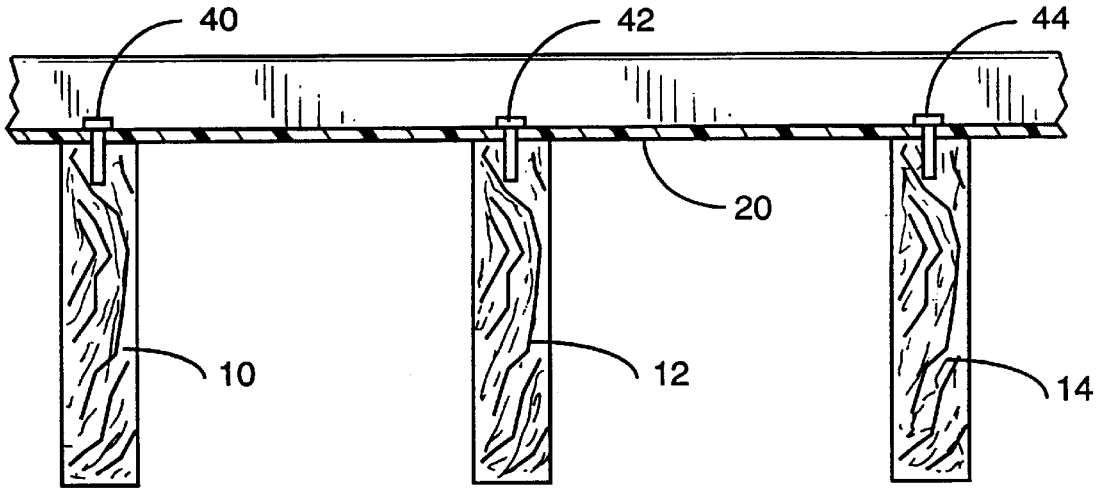
FIG. 2 is a sectional view showing the snap connector of the invention as it is secured to the wood joists.

FIG. 2 shows snap connector 20 as it is mounted to wood joists 10, 12 and 14. Fasteners 40, 42 and 44 are used to secure the snap connector 20 to the respective wood joists. Fasteners 40, 42 and 44 are also shown in FIG. 1. It will be appreciated that similar fasteners (not shown) are used to secure snap connectors 24 and 28 to wood joist 17 and wood joist 14, respectively.

Figure 3:
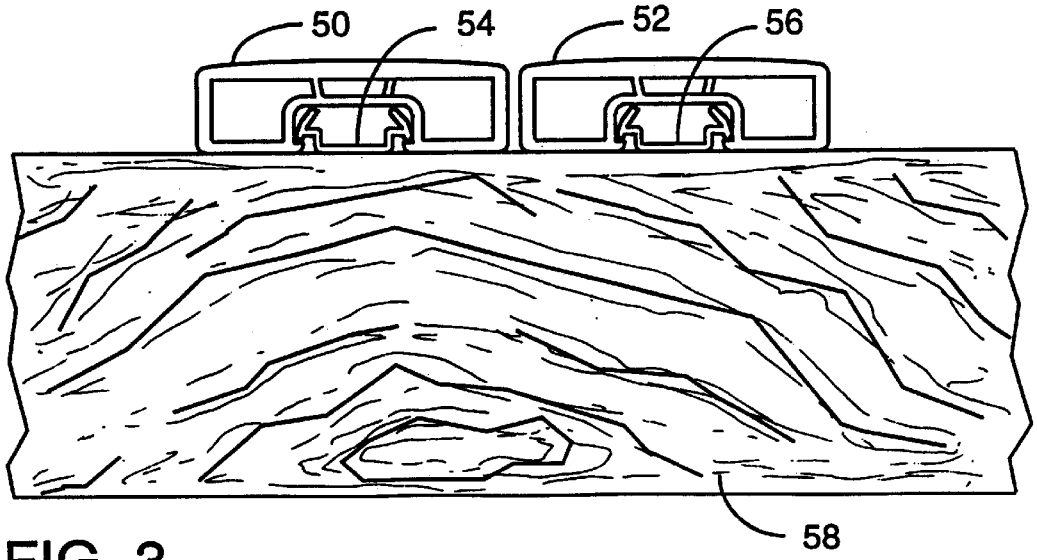
FIG. 3 is an end view showing the profile of the extrusion and the snap connector.

Referring now to FIG. 3, a pair of extrusions 50 and 52 are shown being connected to respective snap connectors 54 and 56 to form the floor assembly. The snap connectors 54, 56 are secured to a wood joist 58 and then the plastic extrusions 50 and 52 are mounted onto their respective snap connectors 54 and 56. Preferably, a gap is provided between the extrusions 50,52 to allow, for example, water and debris to pass therethrough. Preferably the gap between the extrusions 50,52, has a width in the range of 1/16 inch to 3/16 inch, and most preferably is 1/8 inch. Also, the extrusions 50,52 preferably have a crown to allow water, such as rain, to run off of the extrusions 50,52 and through the gap provided therebetween.

Figure 4:
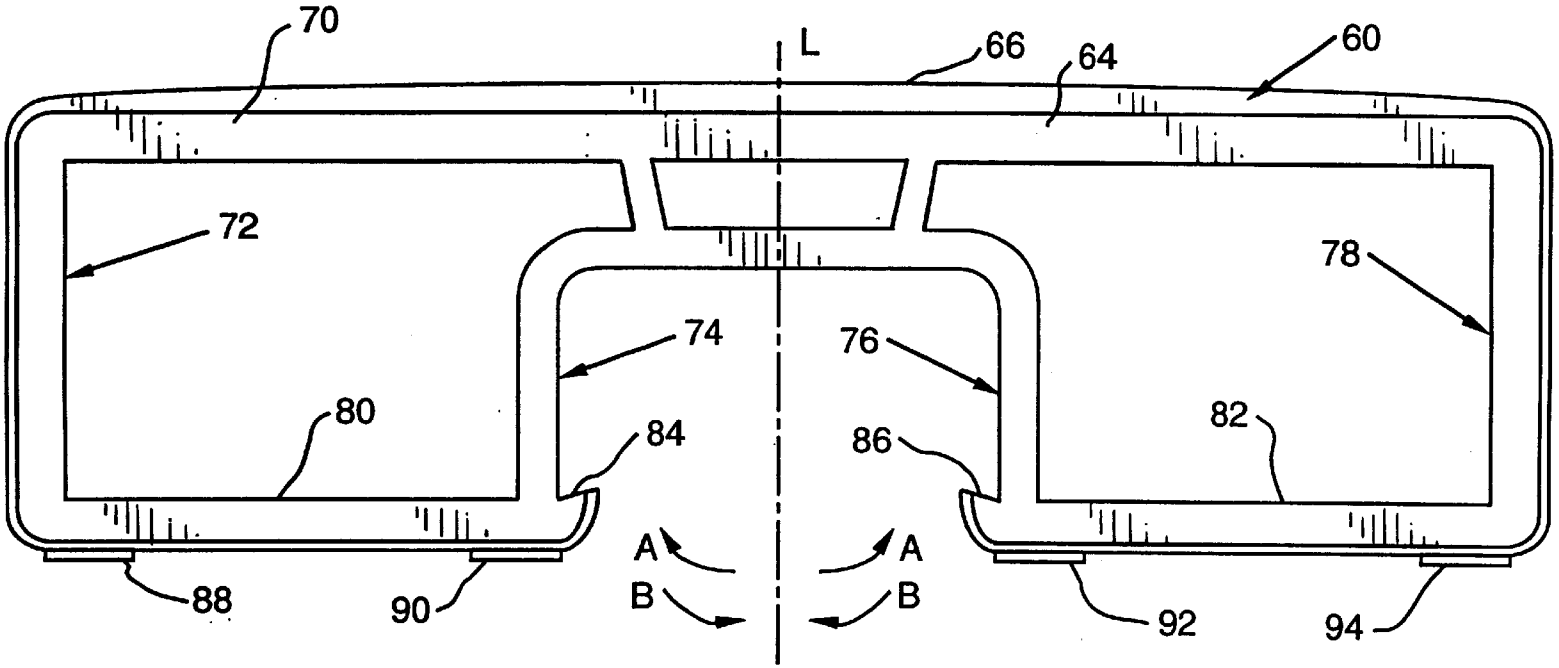
FIG. 4 is a detailed end view of the extrusion.
Figure 5:
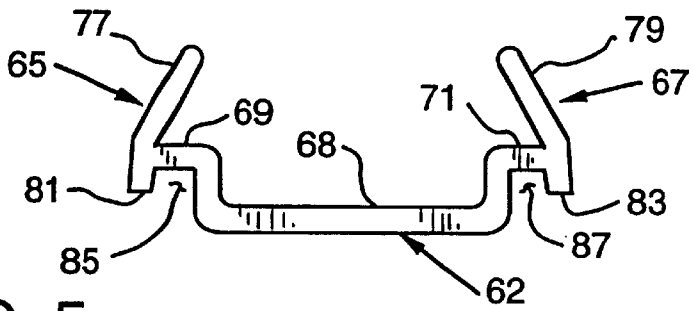
FIG. 5 is an end view of the snap connector.

FIGS. 4 and 5, respectively show end views of a representative extrusion 60 which is connected to a representative snap connector 62. The extrusion 60 consists of a substrate 64 made, preferably, of a recycled polyvinyl chloride (PVC) material, however, any extruded plastic material can be used. The substrate 64 is preferably covered by a virgin capstock material 66 which is co-extruded onto the substrate by known methods. The virgin capstock material 66 is preferably a weatherable, hard, virgin polyvinyl chloride (PVC) material. It will be appreciated that recycled polyvinyl chloride (PVC) can be used as the substrate because the substrate has all of its exposed surfaces covered by the virgin capstock material 66. Thus, the bulk of the extrusion can be made of less expensive, less attractive and readily available recycled polyvinyl chloride (PVC). The material 66 is preferably applied to the substrate so as to provide a crown on the top surface and at the center of the extrusion 60. Advantageously this allows water, such as rain, to run off of the extrusion 60. Of course, it will be appreciated that load bearing portion 70, which will be discussed in detail herein, may also be constructed with a crown or radius to provide for the run off of the water.

Referring further to FIG. 4, the structure of the extrusion 60 includes load bearing horizontal portion 70, a pair of outer leg members 72, 78 and a pair of inner leg members 74, 76, all of which extend generally perpendicularly to the load bearing horizontal portion 70. In accordance with an important aspect of the invention and as will be described in detail herein, horizontal support members 80, 82 are provided having ends connected to outer leg member 72 and inner leg member 74 and to inner leg member 76 and outer leg member 78, respectively. It will further be seen that inner leg members 74, 76 have retaining tabs 84, 86, respectively, that extend generally inwardly therefrom and whose purpose will be discussed further below.

In order to eliminate annoying squeaking sounds which may be made when load bearing objects, such as persons, move across the floor, a soft, polyvinyl chloride (PVC) layer 88, 90, 92, 94 is preferably applied to the bottom surface of each of the horizontal support members 80, 82. This polyvinyl chloride (PVC) layer has a softer durometer than the polyvinyl chloride (PVC) used for the capstock material 66 and the substrate 64. In this way, the soft layers 88, 90, 92, 94 act as a cushion between the wood joist 96 (see FIG. 6) and the remainder of the extrusion 60 so that there is not rigid structure-to-rigid structure contact therebetween. This, in turn, eliminates the annoying squeaking sound common to such floor assemblies.

Referring specifically to FIG. 5, the snap connector 62, which is also preferably made of an extruded polyvinyl chloride (PVC) material, includes an elongated base 63 having a middle section 68 and pair of inverted "L" sections 69 and 71 extending from the opposite edges of the middle section 68. Attached to the "L" sections 69 and 71 are respective flanges 65 and 67 which are disposed in an angular relationship to the "L" sections 69 and 71. Each flange 65 and 67 include respective pilot surfaces 77 and 79, as well as, respective bottom sections 81 and 83. The bottom sections 81 and 83 cooperate with the inner leg members 74,76 and the retaining tabs 84,86 for mechanically securing extrusion 60 to snap connector 62, as will be described in detail herein. Further, the flanges 65,67, along with the wood joist 96 each define a recessed space 85,87.

Figure 6:
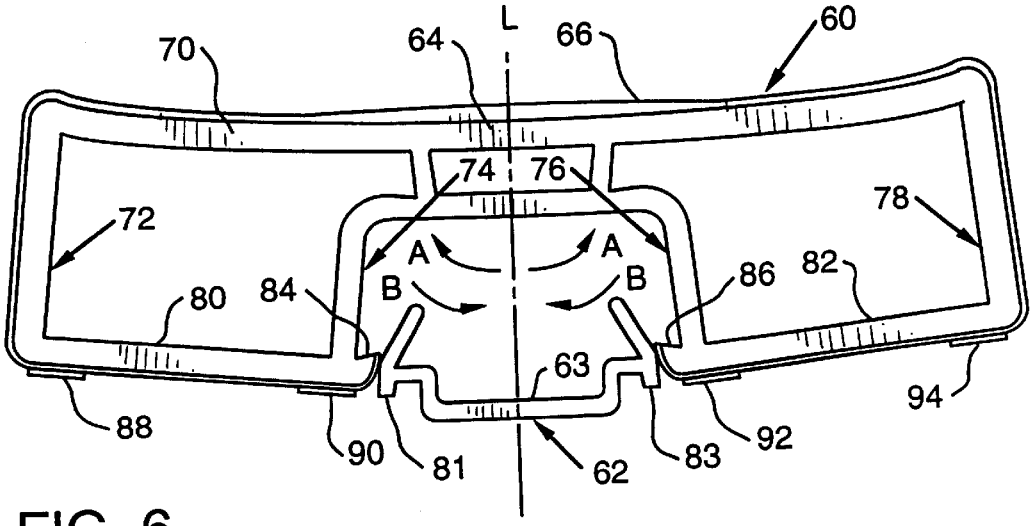
FIG. 6 is a detailed end view showing the extrusion as it is pressed down onto the snap connector.

Referring now to both FIGS. 6 and 7, the operation of a preferred embodiment of the invention will be explained. In order to connect the extrusion 60 to the snap connector 62, the extrusion 60 is merely pressed down on the snap connector 62. As a result of the extrusion 60 being formed of a sufficiently resilient material, the extrusion 60 bends allowing for the extrusion 60 to be pressed onto the snap connector 62 and ultimately being mechanically secured thereto. More specifically, as the extrusion 60 is pressed onto the snap connector 62, the extrusion 60 bends outwardly and upwardly, as indicated by arrows A, about an axis L extending through the center of the extrusion 60. As the extrusion 60 is pressed onto the snap connector 62, the retaining tabs 84, 86 are in intimate contact with the pilot surfaces 77, 79. It will be appreciated that it is the contact between the retaining tabs 84, 86 and the pilot surfaces 77, 79 that actually result in the bending action of the extrusion 60 as described. The forces acting on the retaining tabs 84, 86 are translated to the horizontal support members 80, 82 and the inner leg members 74, 76 during the bending action of the extrusion 60. Horizontal support members 80, 82, as will be appreciated, receive the bulk of the force being applied to the retaining tabs 84, 86. Accordingly, horizontal support members 80, 82 advantageously increase the structural integrity of the extrusion 60 and provide for an extrusion 60 which is superior to known prior art extrusions used in similar floor assemblies.

Figure 7:
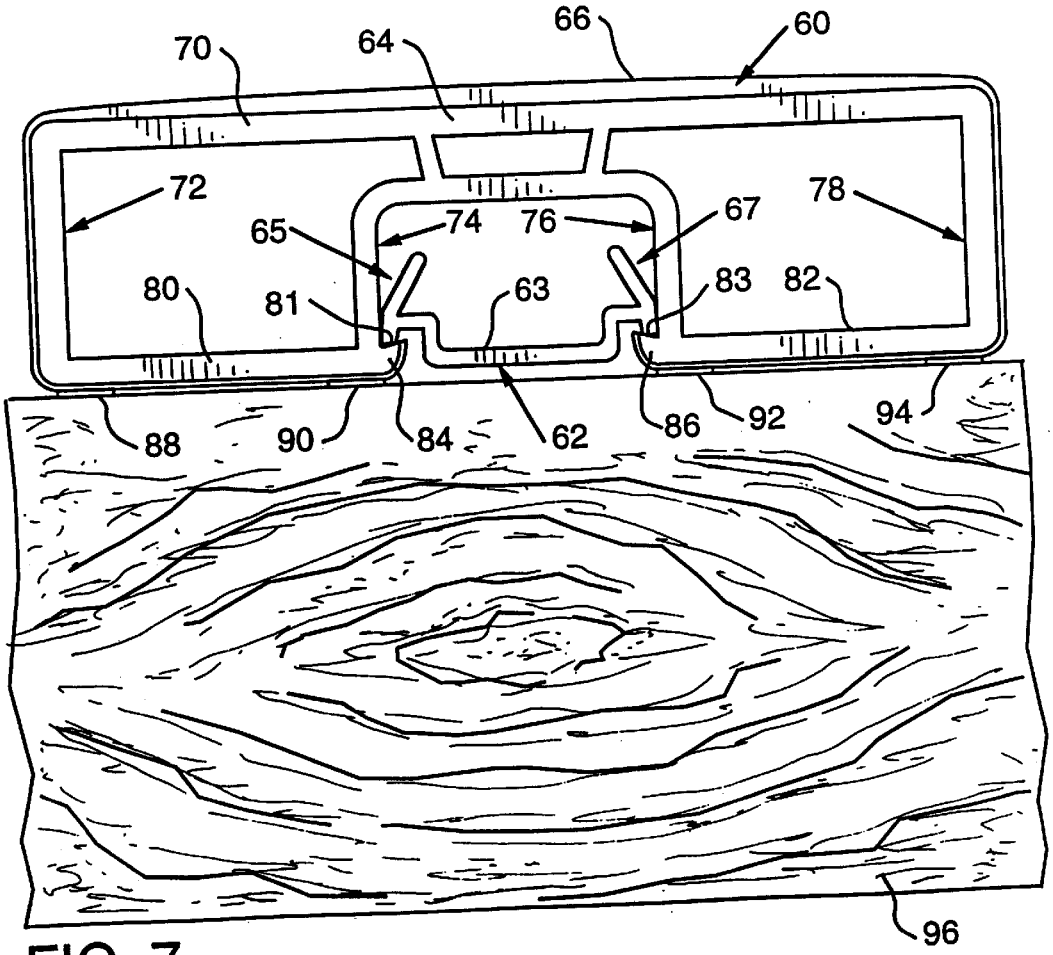
FIG. 7 is a detailed end view showing the extrusion and snap connector as assembled.

Once the extrusion 60, and in particular the retaining tabs 84, 86, are pressed down far enough to clear the bottom sections 81, 83 of the flanges 65, 67, the extrusion 60 and the snap connector 62 snap into position, as shown in FIG. 7. This results in the extrusion 60 being securely connected to the snap connector 62. More specifically, once the retaining tabs 84, 86 clear the bottom sections 81, 83, the extrusion 60 returns to its normal shape, as indicated by arrows B, as opposed to its bended shape during the pressing action. Once the extrusion 60 and the snap connector 62 are securely connected, the bottom sections 81, 83 are in intimate contact with the retaining tabs 84, 86. This results in the bottom sections 81, 83 actually being "wedged in" the corner formed by the retaining tabs 84, 86 and the inner leg members 74, 76. This arrangement resists both upward and side-to-side relative movement of the extrusion 60 with respect to the snap connector 62. As shown, this connection is enhanced by the retaining tabs 84, 86 being received in respective recessed spaces 85, 87 and preventing the extrusion 60 from becoming unconnected from the snap connector 62.

As shown in FIG. 7, connection of the extrusion 60 to the snap connector 62 results in horizontal support member 80 being in direct contact with the top surface of wood joist 96 through soft layers 88, 90 and the remaining area of the horizontal support member 80 being positioned adjacent the top surface of the wood joist 96. Similarly, horizontal support member 82 is in direct contact with the top surface of the wood joist 96 through soft layers 92, 94 and the remaining portion of the horizontal support member is positioned adjacent the top surface of the wood joist 96. Advantageously, the horizontal orientation of the horizontal support members 80, 82 and their indirect contact with the wood joist 96 along with their positioning adjacent the top surface of the wood joist 96 results in improved structural integrity of the extrusion 60. Specifically, the horizontal support members 80, 82 allow for improved structural support once a load is placed on the load-bearing horizontal portion 70. In addition, the horizontal support members 80, 82 provide increased structural stiffness to the inner leg members 74, 76 to counteract the forces being applied to the inner leg members 74, 76 by the flanges 65, 67 as described herein.

It will be appreciated that a floor assembly having a novel and unique extrusion and cooperating snap connector is provided by the present invention. Advantageously, the floor assembly provides for both the extrusion and snap connector to have improved structural integrity, quality, and durability in comparison to prior art floor assemblies having similar arrangements.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An extrusion for use as part of a floor assembly, said floor assembly including a snap connector for securing said extrusion to said snap connector to form said floor assembly, said extrusion comprising:

a pair of outer leg members;

a pair of inner leg members;

an upper load bearing horizontal portion;

each of said outer leg members being connected to an adjacent said inner leg member by a lower horizontal support member that is generally perpendicular to both said respective outer leg members and said respective inner leg member;

said extrusion being made of a resilient material which bends outwardly and upwardly about an axis extending through the center of said extrusion when said extrusion is pressed onto said snap connector and which then snaps inwardly and downwardly to interlock with said snap connector in order to secure said extrusion to said snap connector; and said extrusion is made of a first extruded material and includes an exposed surface and a base surface underlying said exposed surface, said base surface having at least a portion thereof including a second extruded material, said second extruded material resisting undesired squeaking sounds from occurring when weight bearing loads move on said floor assembly.

2. The extrusion of claim 1, wherein said exposed surface has a plurality of depressions defined therein to make said exposed surface slip-resistant.

3. The extrusion of claim 1, wherein said first extruded material has a hardness greater than the hardness of said second extruded material.

4. The extrusion of claim 3, wherein said second extruded material is polyvinyl chloride (PVC).

5. The extrusion of claim 4, wherein said first extruded material is polyvinyl chloride (PVC).

6. The extrusion of claim 5, wherein said extrusion includes a capstock disposed over said exposed surface.

7. The extrusion of claim 6, wherein said capstock is made of virgin weatherable polyvinyl chloride (PVC).

* * * * *